US009295880B2

(12) United States Patent
Mazin

(10) Patent No.: US 9,295,880 B2
(45) Date of Patent: Mar. 29, 2016

(54) HAND-HELD UNDERWATER PROPULSION SYSTEM

(71) Applicant: Ben Mazin, Goleta, CA (US)

(72) Inventor: Ben Mazin, Goleta, CA (US)

( * ) Notice: Subject to any disclaimer, the term of this patent is extended or adjusted under 35 U.S.C. 154(b) by 32 days.

(21) Appl. No.: 14/456,085

(22) Filed: Aug. 11, 2014

(65) Prior Publication Data

US 2015/0047548 A1 Feb. 19, 2015

Related U.S. Application Data

(60) Provisional application No. 61/867,205, filed on Aug. 19, 2013.

(51) Int. Cl.

| | |
|---|---|
| ***B63C 11/46*** | (2006.01) |
| ***A63B 35/12*** | (2006.01) |
| *B60L 11/00* | (2006.01) |
| *B63H 21/17* | (2006.01) |

(52) U.S. Cl.
CPC ..... *A63B 35/12* (2013.01); *B63C 11/46* (2013.01)

(58) Field of Classification Search
CPC ..... A63B 35/12; B63C 11/46; B63H 21/17; B63H 2021/17
USPC ..... 114/312, 313, 315; 440/6
See application file for complete search history.

(56) References Cited

U.S. PATENT DOCUMENTS

| | | | | |
|---|---|---|---|---|
| 6,559,370 | B1 * | 5/2003 | Barker | F42B 19/12 114/20.1 |
| 8,205,570 | B1 * | 6/2012 | Tureaud | B63G 8/14 114/330 |
| 2011/0155840 | A1 * | 6/2011 | Lind, Jr. | B60F 3/00 244/13 |
| 2011/0226174 | A1 * | 9/2011 | Parks | B60F 5/02 114/313 |

* cited by examiner

*Primary Examiner* — Daniel V Venne
(74) *Attorney, Agent, or Firm* — Brown Rudnick LLP; Adam M. Schoen

(57) ABSTRACT

The invention generally relates to hand-held underwater propulsion systems. In certain embodiments, systems of the invention include a hand-held body having a water-tight compartment. There is a motor housed within the water-tight compartment. There are a plurality of propeller blades located at a front portion of the body and coupled to the motor. Each blade includes a retracted configuration and a deployed configuration, and in the deployed configuration, the blades are biased away from the body.

19 Claims, 9 Drawing Sheets

HAND-HELD UNDERWATER PROPULSION SYSTEM

RELATED APPLICATION

The present application claims the benefit of and priority to U.S. provisional application Ser. No. 61/867,205, filed Aug. 19, 2013, the content of which is incorporated by reference herein in its entirety.

FIELD OF THE INVENTION

The invention generally relates to hand-held underwater propulsion systems.

BACKGROUND

A diver propulsion vehicle (also known as an underwater propulsion vehicle or underwater scooter) is an item of diving equipment used to increase range underwater. A diver propulsion vehicle usually consists of a battery-powered electric motor that drives a propeller. There are numerous commercially available diver propulsion vehicles.

A problem with commercially available devices is that they are not designed to assist a user in emergency maritime situations, such as evacuation from a sinking vessel, such as a sinking submarine. For example, one class of diver propulsion vehicles is underwater sleds or scooters. Such devices generally include a large sled or scooter shaped body that includes a permanently deployed propeller coupled to a power supply. An operator grips handles on the body and holds the device in front of themselves so that they can be pulled through the water. A problem with those devices is that they are generally heavy and bulky, making them difficult to maneuver until in the water. That is particularly problematic if the sinking vessel includes narrow passageways and multiple levels, such as a submarine. Additionally, such devices are large so they are required to be stored in equipment compartments that are remote from the operator. Accordingly, such devices are unsuitable for emergency maritime situations.

Another class of diver propulsion vehicles is devices that are designed to be coupled to an operator (e.g., an operator's leg) or the operator's equipment, for example a scuba tank. Such devices also include a permanently deployed propeller coupled to a power supply. Those devices require manual set-up to attach the device to the operator or the operator's equipment, which is time-consuming. Additionally, such devices are not worn by an operator until they are in full gear. Accordingly, such devices are also unsuitable for emergency maritime situations.

SUMMARY

The invention provides hand-held underwater propulsion systems that are designed for portability and easy deployment and use during emergency maritime situations, such as evacuation from a sinking vessel, such as a sinking submarine. Aspects of the invention are accomplished with systems that include a hand-held body having a water-tight compartment. A motor is housed within the water-tight compartment. A plurality of propeller blades are located at a front portion of the body and are coupled to the motor. Each blade includes a retracted configuration and a deployed configuration, and in the deployed configuration, the blades are biased away from the body. In that manner, a user can store such a system on their person or easily retrieve the system from a remote location in an emergency maritime situation. Systems of the invention are configured to allow a user to easily deploy the propeller blades from the body and engage the system so that an operator is pulled through the water and away from the sinking vessel.

Unlike underwater scooters, systems of the invention are low weight, have high thrust, and in certain embodiments are designed for short duration use. For example, a typical underwater scooter weights about 50 lbs., give about 50 lbs. of thrust, and lasts for about an hour. In contrast, systems of the invention weigh about 10 lbs. (e.g., anywhere from about 5 lbs. to about 15 lbs., making systems of the invention portable), give about 100 lbs. of thrust (e.g., anywhere from about 75 lbs. of thrust to 125 lbs. of thrust), and last for about five minutes (e.g., anywhere from 1 minutes up to and including 45 minutes).

Systems of the invention may include numerous configurations. In certain embodiments, the body may be configured to hold the blades in the retracted configuration within the body. While the body may have any shape, in an exemplary embodiment, when the blades are retracted within the body, the body is cylindrically shaped. In an alternative configuration, the body is configured to hold the blades in the retracted configuration against an outer surface of the body. In such configurations, the outer surface of the body may include a recessed portion for each blade in its retracted configuration.

Systems of the invention may have any number of propeller blades, such as two, three, four, five, ten, fifteen, twenty, etc. In an exemplary embodiment, the system includes three blades. The blades may be connected to the body in any manner that allows the blades to move from a retracted configuration to a deployed configuration. In an exemplary embodiment, the blades are hingedly connected to the body. Systems of the invention may additionally include a mechanism that actively releases the blades from the retracted configuration to the deployed configuration, such as a spring-based mechanism.

Any power supply known in the art may be used with systems of the invention. An exemplary power supply is a battery. Any type of battery known in the art may be used with systems of the invention. Exemplary batteries are lithium ion batteries or lithium iron phosphate ($LiFePO_4$) batteries. The power supply may be configured to fit within the water-tight compartment of the body of the device or may be an external battery pack operably coupled to the system.

In certain embodiments, the system also includes a control board. Generally, the control board is housed within the water-tight compartment. The control board may be designed to allow for a plurality of different propeller speeds. Systems of the invention may further include a trigger. Typically, although not required, the trigger is along an external portion of the body and is operably coupled to the system. Compression of the trigger deploys the blades from the retracted configuration to the deployed configuration and initiates the motor. In certain embodiments, the system includes a power engagement level. That allows the power supply (e.g., battery) to be physically disconnected from the motor to ensure that the unit does not turn on accidently.

Optionally, systems of the invention may also include a connector for connecting the system to an operator, such as a handle, a strap, a clip, or combinations thereof. In certain embodiments, a front end of the body includes a nub or a cone, although the front end may also be flat. In certain embodiments, systems of the invention further include a tool, such as a light operably coupled to the body.

While exemplified in the context of emergency maritime situations, systems of the invention have numerous other uses. For example, systems of the invention can be used in combat situations. For example, systems of the invention can be used such that a military diver can quickly leave a combat area. Systems of the invention may also be used for water rescues. For example, systems of the invention may be used by a beach lifeguard to reach a distressed or drowning swimmer more quickly. Additionally, systems of the invention allow a life guard to reach a distressed or drowning swimmer in difficult conditions, such as large rip currents, choppy water, high surf, etc.

BRIEF DESCRIPTION OF THE DRAWINGS

FIG. 2A is a top-down view showing the propeller blades retracted within the body. FIG. 2B is a top-down view showing the propeller blades deployed from within the body. FIG. 2C is a side view showing a member located on the body that is positioned to prevent the propeller blade from deploying. FIG. 2D shows the member retracted so that the propeller blade deploys from the body.

FIG. 3A is a side view showing the propeller blades retracted against the body. FIG. 3B is a side view showing a recessed portion for each blade in its retracted configuration. FIG. 3C is a side view showing members that retain the propeller blade and prevent the propeller blade from deploying.

DETAILED DESCRIPTION

The invention generally relates to hand-held underwater propulsion systems. Unlike underwater scooters, systems of the invention are low weight, have high thrust, and in certain embodiments are designed for short duration use. For example, a typical underwater scooter weights about 50 lbs., give about 50 lbs. of thrust, and lasts for about an hour. In contrast, systems of the invention weigh about 10 lbs. (e.g, anywhere from about 5 lbs. to about 15 lbs., making systems of the invention portable), give about 100 lbs. of thrust (e.g., anywhere from about 75 lbs. of thrust to 125 lbs. of thrust), and last for about five minutes (e.g., anywhere from 1 minutes up to and including 45 minutes).

Figure 1A:
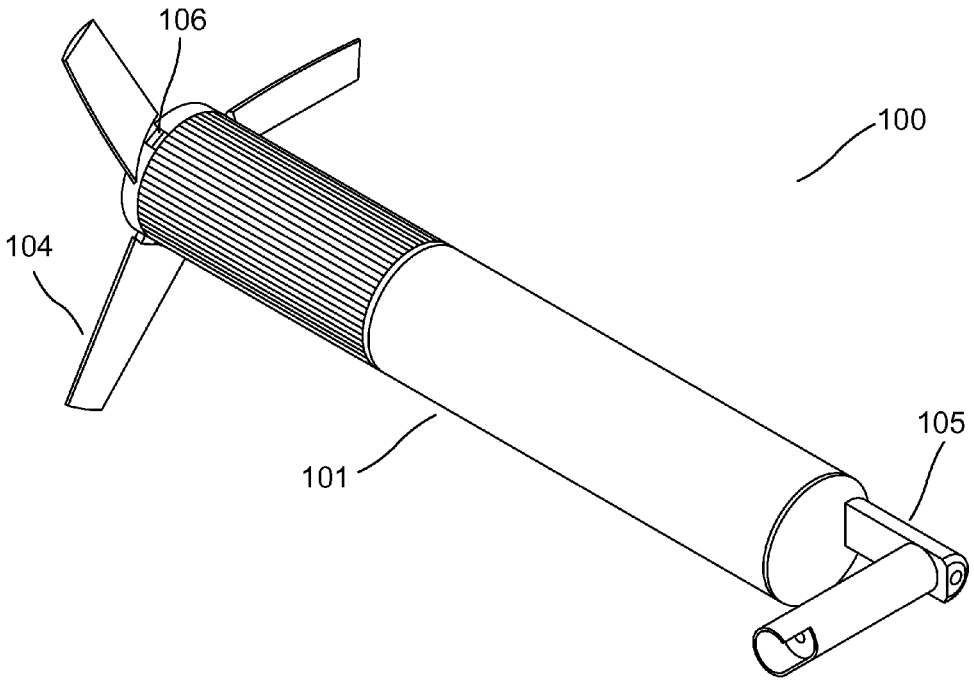
FIG. 1A shows an exemplary embodiment of systems of the invention.

FIG. 1A shows an exemplary embodiment of a system 100 of the invention. The system includes a hand-held body 101. In FIG. 1A, the body 101 is shown as having a cylindrical shape. Such shape is exemplary and not limiting of the invention, and systems of the invention may have any shape. The body 101 is from about 15 inches long to about 45 inches long. The body 101 is from about 5 inches in circumference to about 40 inches in circumference. Such dimensions are only exemplary, and systems of the invention may have any dimensions. The body 101 may be composed of metal, metal alloys, polymers, plastics, and/or combinations thereof.

At a front portion of the body 101 is a plurality of propeller blades 104. The location of the blades shown in FIG. 1A is exemplary. The blades 104 may be located at a distal end of the body 101, as shown in FIG. 1A, or located closer to the back end of the body 101, while still being part of the front half, i.e., front portion. Systems of the invention may have any number of propeller blades, such as two, three, four, five, ten, fifteen, twenty, etc. In the exemplary embodiment shown in FIG. 1A, the system includes three blades. Each blade in FIG. 1A is shown as being canted. The blades do not need to be canted and can be canted at a steeper or more shallow angle than is shown in FIG. 1A. Any propeller design or type that translates power by converting rotational motion into thrust may be used with systems of the invention. Aspects of propeller design are described for example in Russell ("Secrets of Propeller Design book: History & Design of Propellers", 2013); Hannan ("Strategy of propeller design", T. Reed, 1971), and van Oossanen ("Calculation of performance and cavitation characteristics of propellers including effects of non-uniform flow and viscosity", 1972), the content of each of which is incorporated by reference herein in its entirety.

Figure 1B:
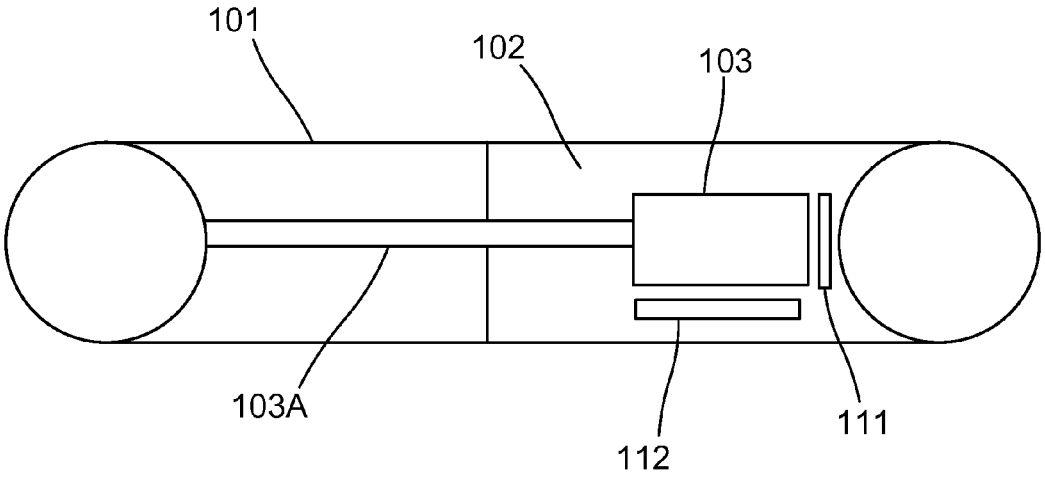
FIG. 1B shows an exemplary configuration of an inside of a body of systems of the invention.

The hand-held body includes a water-tight compartment 102, as shown in FIG. 1B. The configuration of the water-tight compartment shown in FIG. 1B is only exemplary, and other sizes and dimensions are within the scope of the invention. In certain embodiments, almost all or all of the inside of the body 101 is a water-tight compartment. With system 100, there is a motor 103 housed within the water-tight compartment 102. The motor 103 is operably coupled to a rotary drive shaft 103A. The rotary driveshaft 103A extends through the water-tight compartment 102 and couples to a hub that is connected to the propeller blades 104. The motor 103 drives rotation of the drive shaft 103A, which drives rotation of the propeller blades 104. Seals are used at the location where the drive shaft 103A exits the water-tight compartment 102 in order to maintain the integrity of the water-tight compartment 102. Such seals are commercially available, for example, from Kaydon Ring & Seal, Inc. (Baltimore, Md.) or Parker Hannifin Corporation (Cleveland, Ohio).

Each of the propeller blades 104 includes a retracted configuration and a deployed configuration. FIG. 1A shows the blades 104 in the deployed configuration. In the deployed configuration, the blades 104 are biased away from the body, as shown in FIG. 1A. Biasing of the blades 104 is important because deployment of the blades 104 typically coincides with initiation of rotation of the blades 104. If the blades 104 are not biased away from the body 101 at the time of deployment, the blades 104 may contact the body 101 while they spin-up to full speed. Such contact could damage the blades 104, the body 101, and/or the operator. By causing the blades 104 to be biased away from the body 101, the blades 104 can rotate freely without contacting the body 101.

Figure 2A:
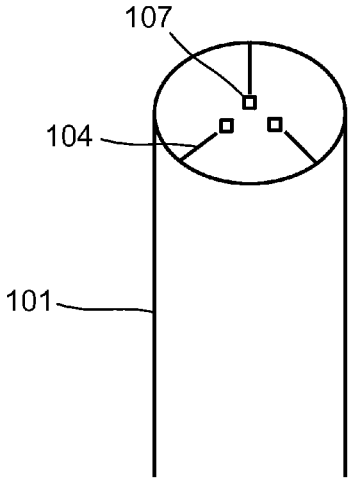
FIGS. 2A-D show exemplary embodiments of propeller blades retracted within the body of systems of the invention and deployed from within the body of systems of the invention.
Figure 2B:
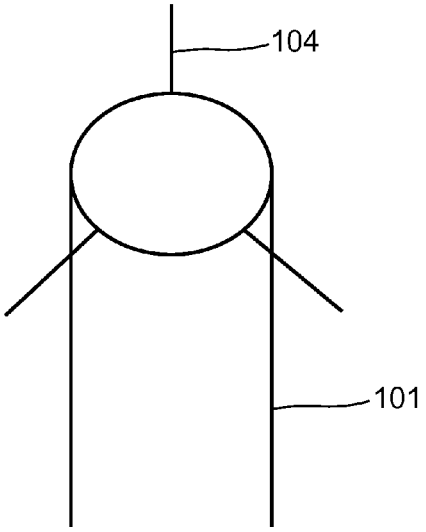
Figure 2C:
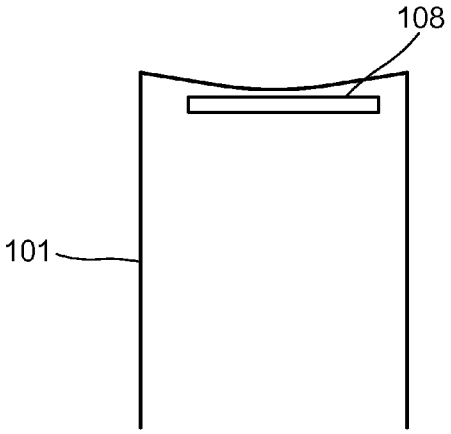
Figure 2D:
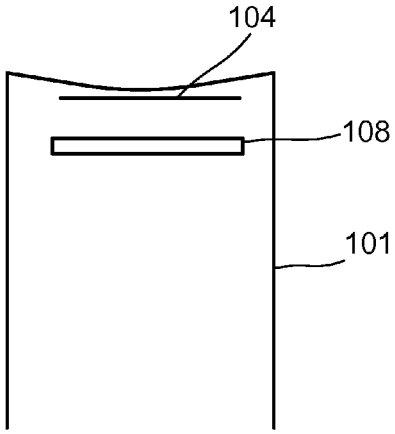

Systems of the invention may include numerous retracted configurations for the blades 104. In certain embodiments, the body 101 may be configured to hold the blades 104 in the retracted configuration within the body 101. Such a configuration is shown in FIGS. 2A-D. In such an embodiment, the body 101 is sized to accommodate the blades 104 within the body 101. The body 101 includes spring mechanisms 107. In the exemplary embodiment, there is a spring mechanism 107 associated with each blade 104. Alternative, a single spring mechanism 107 can be centrally located with respect to the blades 104 in order to act on each blade 104. The blades 104 are spring-loaded and held within the body 101 by a member 108 that prevents their release from the body 101 (FIGS. 2A and 2C). An exemplary member 108 is a retractable door or retractable nub. The body is configured so that there is a member 108 associated with each blade 104. The blades 104 abut the members 108, and the members 108 retain the blades 104 within the body 101 by providing a counter-force to the spring mechanism 108. The member 108 is coupled to a trigger. Actuating the trigger causes the member 108 to be retracted, removing counter force from a distal end of the blades 104, thereby causing the blades 104 to be pushed-out from within the body into their deployed configuration (FIGS. 2B and 2D). While the body 101 may have any shape, in an exemplary embodiment, when the blades 104 are retracted within the body 101, the body 101 is cylindrically shaped.

Figure 3A:
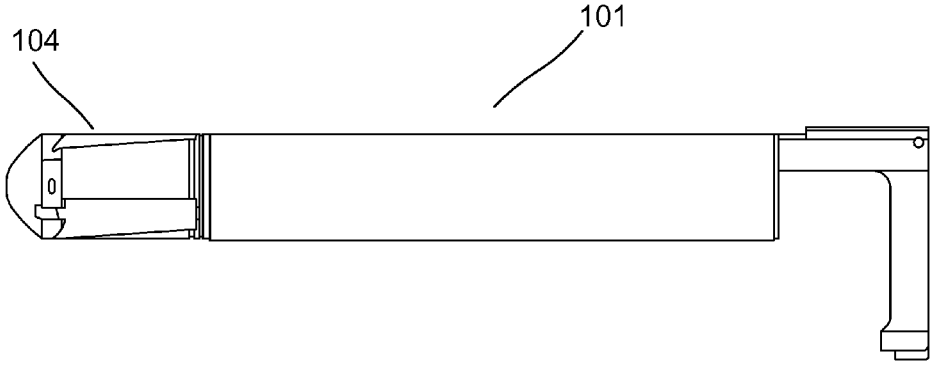
FIGS. 3A-C show exemplary embodiments of propeller blades retracted against an outer-surface of a body of systems of the invention and deployed from against the body of systems of the invention.
Figure 3B:
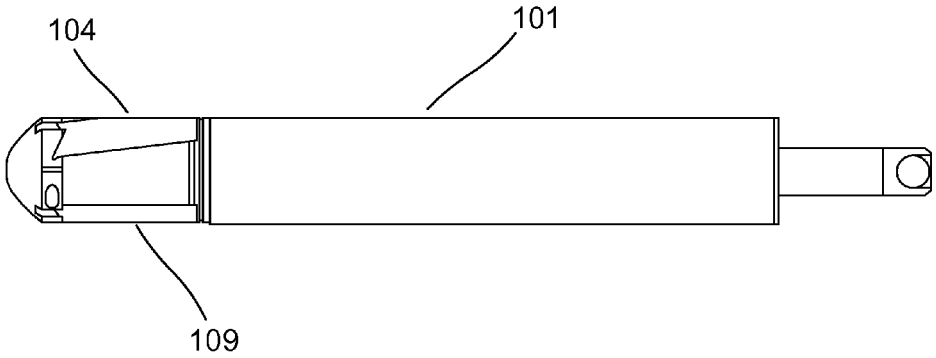

In an alternative configuration, the body 101 is configured to hold the blades 104 in the retracted configuration against an outer surface of the body 101 (FIG. 3A). In such configurations, the outer surface of the body 101 may include a recessed portion 109 for each blade in its retracted configuration (FIG. 3B). In this embodiment, each blade includes a hinge 106 (FIG. 1A). The hinge 106 allows the blades 104 to pivot. The hinge is spring loaded so that the blades 104 bias away from the body 101 in the deployed configuration. In this embodiment, a retaining sleeve may be used to hold the blades 104 against the body 101, providing a counter-force that prevents release of the blades 104. Removing the sleeve causes the blades to move to their deployed configuration via pivoting of the spring loaded hinges 106.

Figure 3C:
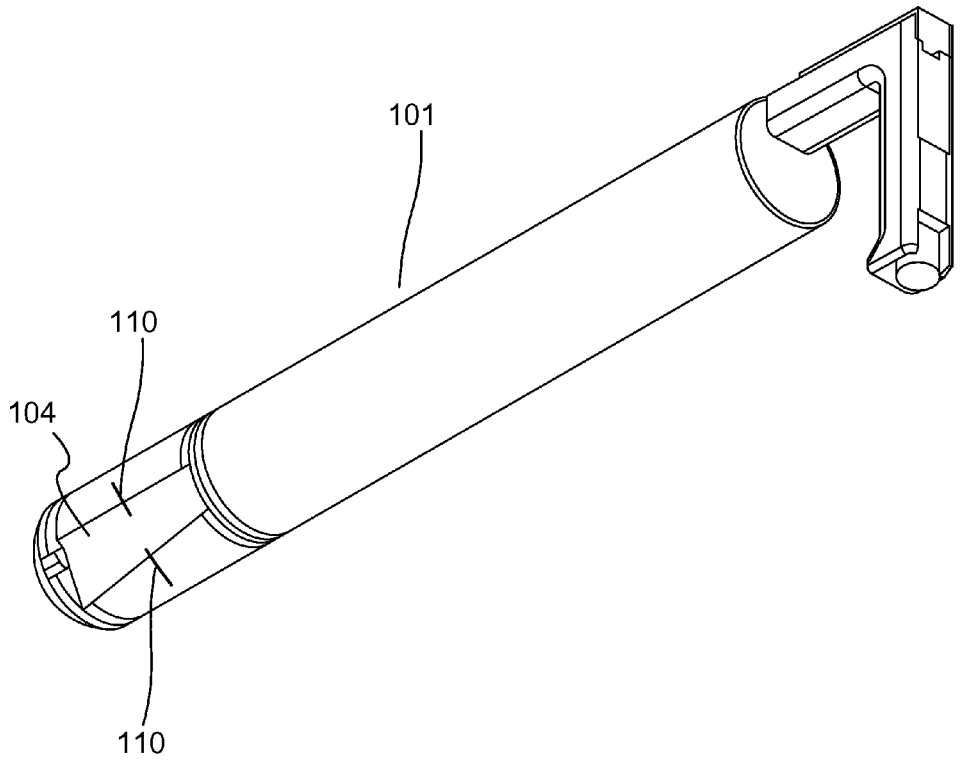

Alternatively, members 110 are used to retain the blades 104 in their retracted configuration (FIGS. 3C-3D). The body is configured so that there is one or more members 110 associated with each blade 104. The blades 104 are retained by the members 110 by providing a counter-force to the spring loaded hinge 106 (FIG. 3C). Exemplary members are flanges. The members 110 are coupled to a trigger. Actuating the trigger causes the members 110 to be retracted, removing counter force from the blades 104, thereby causing the blades 104 to pivot out away from the body into their deployed configuration (FIG. 1A).

Figure 4:
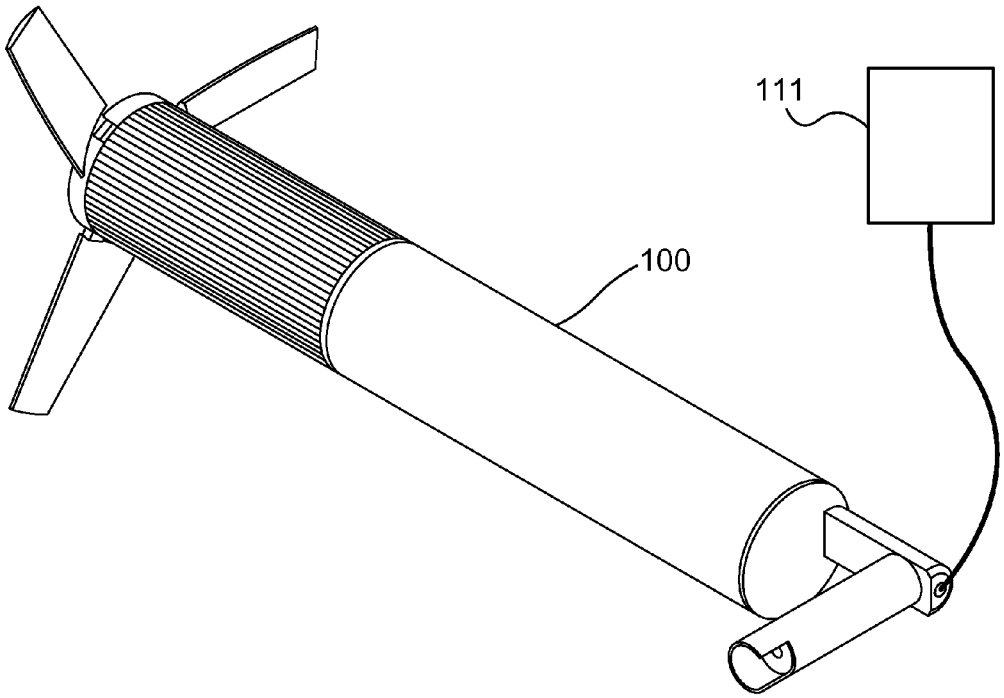
FIG. 4 shows an exemplary embodiment of a system of the invention with an external power supply.

The water-tight compartment 102 of the body 101 also houses a power supply 111 (FIG. 1B). The power supply 111 is operably coupled to the motor 103 via standard connections well known in the art. Any portable and discrete power supply may be used with systems of the invention. An exemplary power supply is a battery. Any type of battery known in the art may be used with systems of the invention. Exemplary batteries are lithium ion batteries or lithium iron phosphate ($LiFePO_4$) batteries. As shown in FIG. 1B, the power supply 111 may be configured to fit within the water-tight compartment 102 of the body 101 of the system. Alternatively, the power supply 111 may be configured as an external battery pack operably coupled to the system 100 (FIG. 4).

In certain embodiments, the water-tight compartment 102 of the body 101 also houses a control board 112 (FIG. 1B). The control board 112 is operably coupled to the power supply 111 and/or motor 103 via standard connections well known in the art. An exemplary control board is a microprocessor board, such as those produced by Arduino, or a programmable logic controller (PLC). In certain embodiments, the control board 112 allows for a plurality of different propeller speeds.

Figure 5:
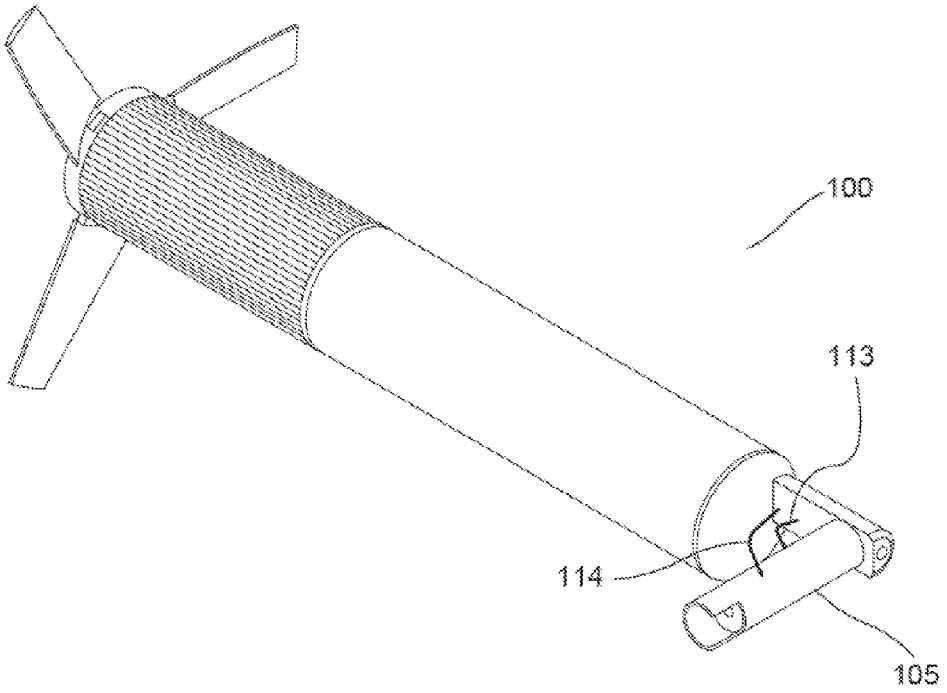
FIG. 5 shows an exemplary embodiment of a system of the invention with a single trigger mechanism.

Systems of the invention include at least one trigger. The trigger is located along an external portion of the body and is operably coupled to the system. Any exemplary set-up is shown in FIG. 5, in which the system includes a trigger 113 on a handle 105 of the body 101. For safety, in certain embodiments, system 100 includes a trigger guard 114, as shown in FIG. 5. The trigger 113 is operably coupled to the control board 112 and optionally to the members that retain the blades 104 in the retracted configuration. In this embodiment, compression of the trigger releases the blades to their deployed configuration and initiates the motor to cause rotation of the blades. In embodiments in which the control board 112 allows for a plurality of different propeller speeds, such control can be through the trigger 113. In alternative embodiments, systems of the invention include two triggers, a first trigger that controls deployment of the blades and a second trigger that controls propulsion of the system. In certain embodiments, the system includes a power engagement level. That allows the power supply (e.g., battery) to be physically disconnected from the motor to ensure that the unit does not turn on accidently.

Figure 8:
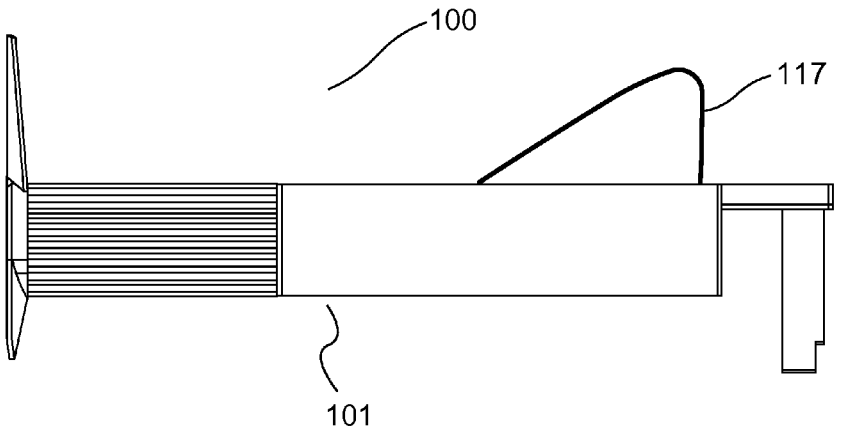
FIG. 8 shows an exemplary embodiment of a system of the invention having a fin at a rear portion of the system.

In certain embodiments, systems of the invention includes at least one fin 117 (FIG. 8). The fin 117 has a retracted configuration and a deployed configuration. In the retracted configuration, the fin 117 is either held within the body 101 or held against the body 101. In a deployed configuration, the fin 117 is biased away from the body 101. In FIG. 8, the fin 117 is shown in the deployed configuration. The fin 117 is positioned to counter the torque from the motor 103. While FIG. 8 shows an exemplary position of the fin 117 at a distal portion of the body 101, the fin may be located anywhere on the body 101. For example, the fin may be located on the top of the body, on the bottom of the body, or on either side of the body. In certain embodiments, more than one fin is used. In such embodiments, there may be fins on the top, bottom, and/or either or both sides of the body. For example, there may be fins on the top and bottom of the body. There may be fins on the left and right sides of the body. There may be fins on the sides and top of the body. There may be fins on the sides and bottom of the body. There may be fins on the top, bottom, and sides of the body. The fin may be located at a distal end of the body, a proximal end of the body, or any position along the body. In embodiments that use more than one fin, the fins may be positioned along the same location of the body. Alternatively, the fins may be staggered about different locations on the body. FIG. 8 also depicts exemplary shapes and sizes for the fin, however the invention is not limited to those shapes and dimensions. The fin may have any shape or any dimension.

In certain embodiments, systems of the invention include a connector for connecting the system to an operator. Any type of connector known in the art may be used with systems of the invention. An exemplary connector is a handle 105 as shown in FIG. 1A. Such a connector is only exemplary, and types of connectors can be used, such as straps, clips, or combinations of any of the above, such as a handle that also includes a strap or a clip.

Figure 6:
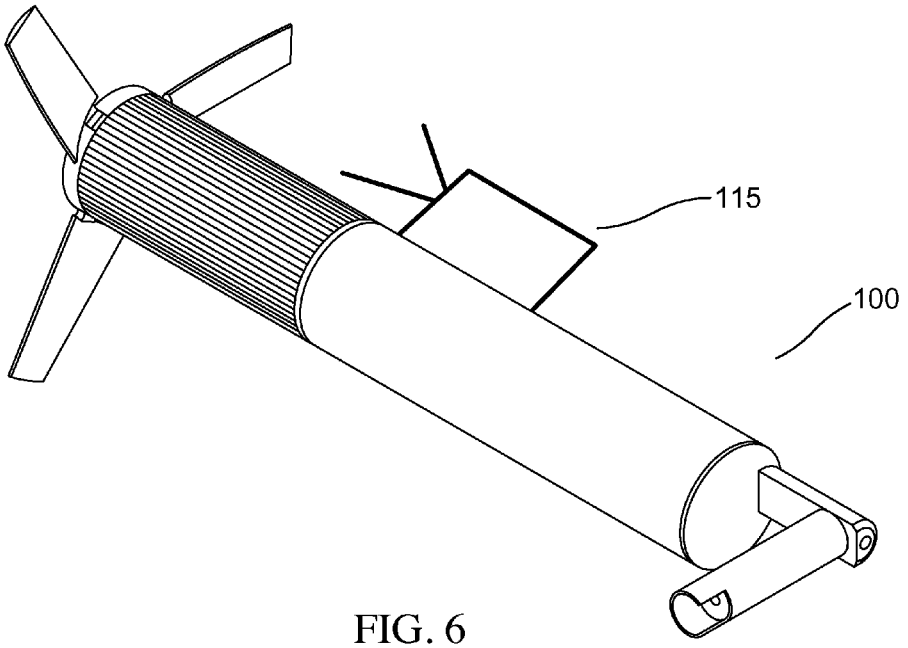
FIG. 6 shows an exemplary embodiment of a system of the invention having a light.
Figure 7:
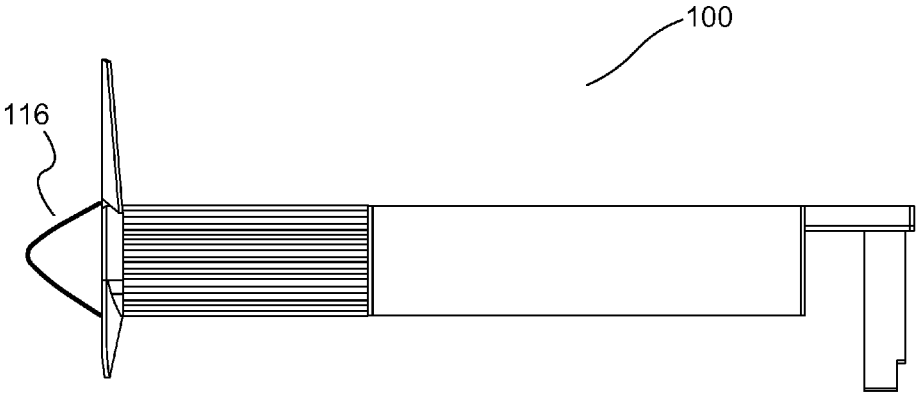
FIG. 7 shows an exemplary embodiment of a system of the invention having a cone at a front end of the system.

One of skill in the art will recognize that the embodiments described herein are exemplary, and that the invention encompasses other embodiments, such as those in which a functional tool is attached to the system, such as a cutter or a light. FIG. 6 shows an exemplary embodiment in which a light 115 is coupled to the system. The placement of the light is exemplary, and it can be placed in any section that does not interfere with the rotation of the blades. In certain embodiments, it is placed ahead of the blades on the front tip of the system. In other embodiments, the front end of the device includes a nub or a cone. For example, FIG. 7 shows an embodiment of a system of the invention having a nose cone 116.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A hand-held underwater propulsion system, the hand-held underwater propulsion system comprising:

a body comprising a water-tight compartment and a handle that extends from the body;

a motor housed within the water-tight compartment; and a plurality of propeller blades located at a front portion of the body and coupled to the motor, each of the plurality of propeller blades comprising a retracted configuration and a deployed configuration, wherein in the deployed configuration, the plurality of propeller blades are biased away from the body;

wherein the hand-held underwater propulsion system is configured such that when in operation, the hand-held underwater propulsion system pulls a user through the water.

2. The hand-held underwater propulsion system according to claim 1, wherein the body is configured to hold the plurality of propeller blades in the retracted configuration within the body.

3. The hand-held underwater propulsion system according to claim 2, wherein when the plurality of propeller blades are retracted within the body, the body is cylindrically shaped.

4. The hand-held underwater propulsion system according to claim 1, wherein the body is configured to hold the plurality of propeller blades in the retracted configuration against an outer surface of the body.

5. The hand-held underwater propulsion system according to claim 4, wherein the outer surface of the body comprises a recessed portion for each of the plurality of propeller blades in the retracted configuration.

6. The hand-held underwater propulsion system according to claim 1, wherein the hand-held underwater propulsion system comprises three blades.

7. The hand-held underwater propulsion system according to claim 1, wherein the plurality of propeller blades are hingedly connected to the body.

8. The hand-held underwater propulsion system according to claim 1, further comprising a control board within the water-tight compartment.

9. The hand-held underwater propulsion system according to 8, wherein the control board allows for a plurality of different propeller speeds.

10. The hand-held underwater propulsion system according to claim 1, further comprising a trigger along an external portion of the body that is operably coupled to the hand-held underwater propulsion system.

11. The hand-held underwater propulsion system according to claim 10, wherein compression of the trigger deploys the plurality of propeller blades from the retracted configuration to the deployed configuration and initiates the motor.

12. The hand-held underwater propulsion system according to claim 1, wherein a front end of the body comprises a cone.

13. The hand-held underwater propulsion system according to claim 1, further comprising a power supply configured to fit within the water-tight compartment.

14. The hand-held underwater propulsion system according to claim 13, wherein the power supply is a lithium ion battery.

15. The hand-held underwater propulsion system according to claim 1, further comprising an external battery pack operably coupled to the hand-held underwater propulsion system.

16. The hand-held underwater propulsion system according to claim 1, further comprising a mechanism that actively ejects the blades from the retracted configuration to the deployed configuration.

17. The hand-held underwater propulsion system according to claim 16, wherein the mechanism is a spring-based mechanism.

18. The hand-held underwater propulsion system according to claim 1, further comprising a light operably coupled to the body.

19. The system according to claim 1, further comprising a fin, the fin having a retracted configuration and a deployed configuration.

* * * * *